United States Patent [19]

Obenshain

[11] 4,136,864

[45] Jan. 30, 1979

[54] SHEET STACKING DEVICE

[75] Inventor: David N. Obenshain, Swanton, Md.

[73] Assignee: Westvaco Corporation, New York, N.Y.

[21] Appl. No.: 807,115

[22] Filed: Jun. 16, 1977

[51] Int. Cl.[2] ..... B65H 31/10; B65H 31/20

[52] U.S. Cl. ..... 271/217; 83/92; 214/6 H; 271/221

[58] Field of Search ..... 271/217, 218, 219, 215, 271/214, 221, 222; 214/6 H; 83/92, 91

[56] References Cited

U.S. PATENT DOCUMENTS

| | | | |
|---|---|---|---|
| 2,849,236 | 8/1958 | Beaulieu | 214/6 H |
| 3,272,044 | 9/1966 | Obenshain | 83/79 |
| 3,471,142 | 10/1969 | Bergez | 271/218 X |
| 3,516,658 | 6/1970 | Taylor et al. | 271/215 |
| 3,923,299 | 12/1975 | Taylor et al. | 271/221 |

*Primary Examiner*—Bruce H. Stoner, Jr.

[57] ABSTRACT

A machine for continuously cutting a web of paper or the like into sheets of different length and then sorting and stacking the sheets includes an improved sheet stacking mechanism for stacking a wide range of sheet sizes. The sheet stacking mechanism comprises a multiple section skid lift assembly, means for automatically and continuously lowering the skid lift assembly to accomodate the increasing height of the stacked sheets, a pneumatically actuated jogger rail system including joggers for successively aligning the edges of the stacked sheets and an adjustable tamper device for stabilizing the sheets on the stack.

2 Claims, 6 Drawing Figures

SHEET STACKING DEVICE

BACKGROUND OF INVENTION

The present invention relates generally to the art of cutting, sorting, transporting and stacking paper webs or the like in sheet form in a continuous operation. More particularly, the present invention relates to an improvement in a sheet stacking mechanism for such a machine where the machine has the capability of cutting the web into a wide range of sheet sizes.

The invention was developed in connection with other improvements to the sheet cutting and stacking machines disclosed generally in applicant's prior U.S. Pat. Nos. 3,203,326 and 3,272,044, however, the invention herein is not limited to such an application. For instance, the stacking mechanism of the present invention could be used independently in any application requiring the stacking of sheets such as a printing press. However, as disclosed herein the continuous operation is performed at high speed, preferably on a single web of paper, and the final stacked sheets are sold under the registered trademark AccuTrim paper, marketed by the Assignee herein.

The invention is an improvement in the machines disclosed in U.S. Pat. Nos. 3,203,326 and 3,272,044, the disclosures of which are incorporated herein by reference. More particularly, the present invention comprises an improved sheet stacking mechanism for handling a wide range of sheet sizes.

The stacking mechanism is located at the off-loading end of a machine having a fixed height sheet delivery mechanism substantially as disclosed in the prior art. However, with the apparatus of the present invention, the stacked sheets can be more quickly and readily removed from the stacker than is possible with prior art systems, which produces concomitant increases in production efficiency. Further, the stacking mechanism of the present invention accomplishes its goals with less demand on the machine operator and with more automatic control than the systems of the prior art. For instance, the prior art machines require elevated platforms and walkways for tending, whereas with the machine of the present invention, all operator functions are performed from the operating floor level.

The following prior U.S. patents are exemplary of the known sheet stacking mechanisms: Nos.

1,863,465
1,942,172 (271-88)
1,519,817 (112-10)
2,700,947 (112-10)

In U.S. Pat. No. 1,519,817, there is disclosed a sheet delivery mechanism with means for automatically lowering the paper holding table as the sheets are piled thereon. However, the means is such that only an intermittent lowering action can be achieved. U.S. Pat. No. 1,863,465, discloses a sheet stacking mechanism which includes jogger devices wherein actuation of the joggers also provides for vertical positioning of the stack. However, the mechanism is comprised of a complicated gear train without any real control and without a readily useable system for stacking different length sheets, nor for easily removing the stacked sheets from the machine. U.S. Pat. No. 1,942,172 discloses yet another sheet stacking device which is designed to both jog the stacked sheets and adjust the height of the stack as additional sheets are delivered to the stack. Meanwhile, U.S. Pat. No. 2,700,947 illustrates a sheet stacking device which automatically lowers the stacking table to accomodate the successively increasing height of the stack of cut sheets. The apparatus disclosed therein utilizes a drive much like that preferred by applicant herein but without the different sheet length stacking capability of the present device and without the desired automatic control disclosed herein.

SUMMARY OF INVENTION

The present invention relates to mechanical improvements in the machines disclosed in prior U.S. Pat. Nos. 3,203,326 and 3,272,044 which permits the machines to more readily stack a wide range of sheet sizes and for improving the conditions for removing finished stacks from the machine. The mechanical improvements comprise (1) a multiple section skid lift platform and means for actuating one or more of the sections of the lift platform to accomodate a skid for the desired sheet size being stacked; (2) automatic means responsive to the machine speed and proportional to sheet caliper for automatically lowering the selected skid lift sections in a continuous manner as sheets are delivered to the stacking mechanism; (3) a pneumatically actuated jogger rail system which is actuatable to lower the joggers down, onto the skid when starting a stack, and for raising the joggers out of the way when the stack is finished, to permit removal of the finished skid in any desired direction, and, (4) a tamper device which is also adjustable in position for skid removal and/or for use in stabilizing the sheets stacked on the skid.

DETAILED DESCRIPTION

Figure 1A:
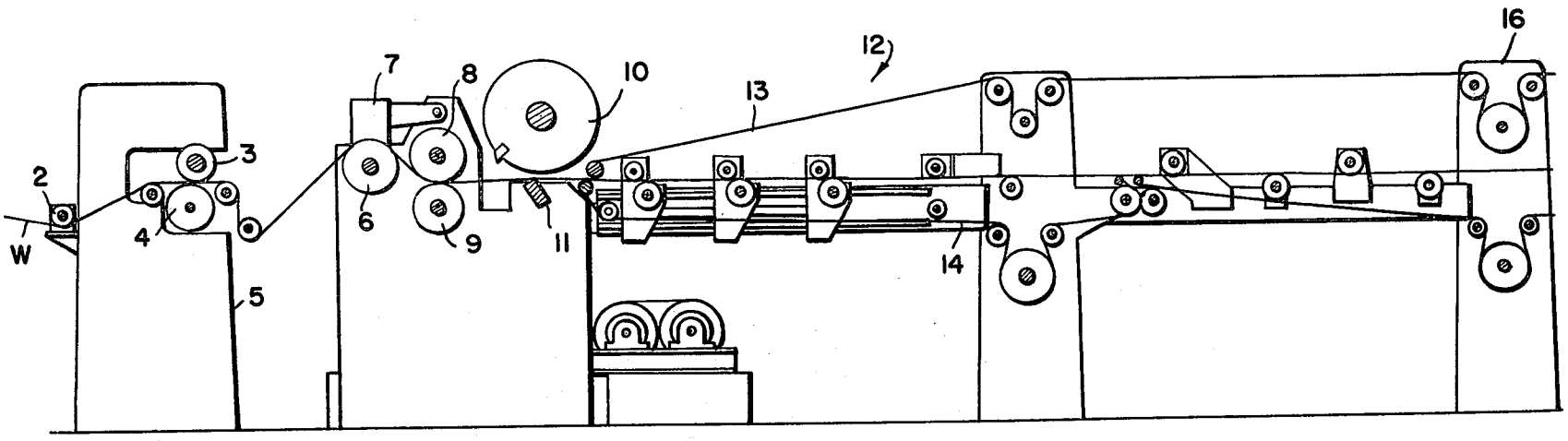
FIG. 1A shows schematically a first part of a machine for cutting and transporting sheets of paper from a web.
Figure 1B:
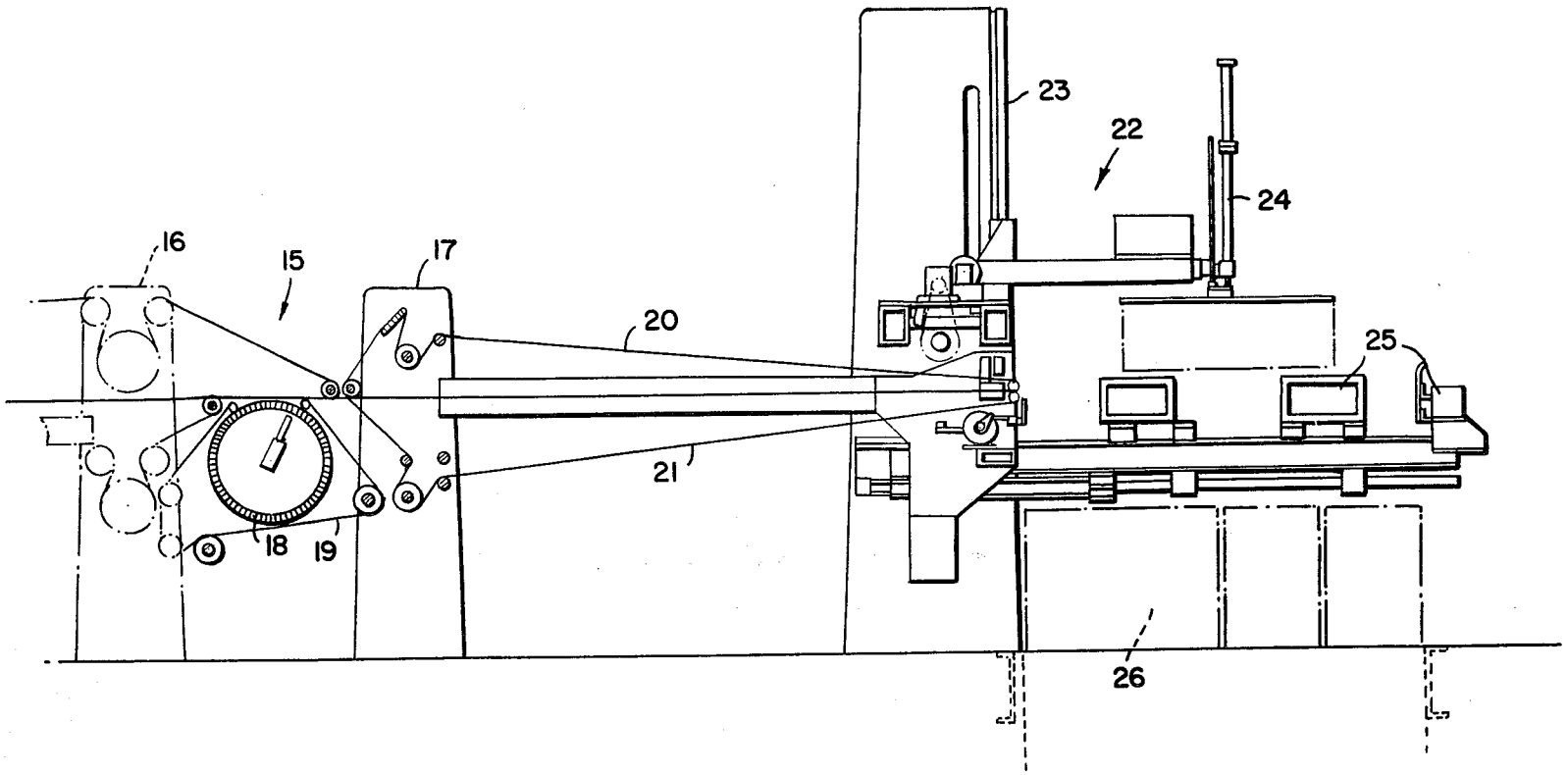
FIG. 1B shows schematically the second part of the machine of FIG. 1A, which incorporates the stacking mechanism of the present invention.

The sheet stacking system is shown in connection with the machine disclosed in FIGS. 1A and 1B as a preferred embodiment for illustrative purposes only. The apparatus shown in FIGS. 1A and 1B is more fully described in copending U.S. patent application Ser. No. 755,971, filed Dec. 29, 1976, now U.S. Pat. No. 4,056,023, the disclosure of which is incorporated herein by reference.

In general, the sheet stacking mechanism 22 is mounted on a suitable machine frame 23 and incorporates a sheet tamping device 24, a jogger rail lift system including individual jogger devices 25 and a multiple section skid lift platform 26 suitable for handling a wide range of sheet sizes. In one embodiment of the present invention, the range of sheet sizes is from about 17 × 25 inches to about 52 × 78 inches. In the preferred embodiment shown, the skid lift platform is divided into three adjacent sections A, B, and C located in an underfloor area at the end of the machine. Each section is individually driven in a vertical plane so that one, two or all three sections can be simultaneously used depending on the sheet length that is to be stacked. Thus, for stacking the shortest sheets, only section A of the skid lift platform would be used. For medium length sheets, both sections A and B would be used and for the longest sheets, all three sections A, B and C would be used to support the stacking skid. As illustrated in FIG. 1B, the jogger rail assembly and tamper mechanism are both adjustable inwardly and outwardly for accomodating the sheet size being stacked. Moreover, each mechanism can be moved up and down as desired for stacking and for stack removal. Meanwhile, the tamper mechanism is mounted on the carriage which supports the jogger rails and moves up and down with the jogger rails.

Figure 2:
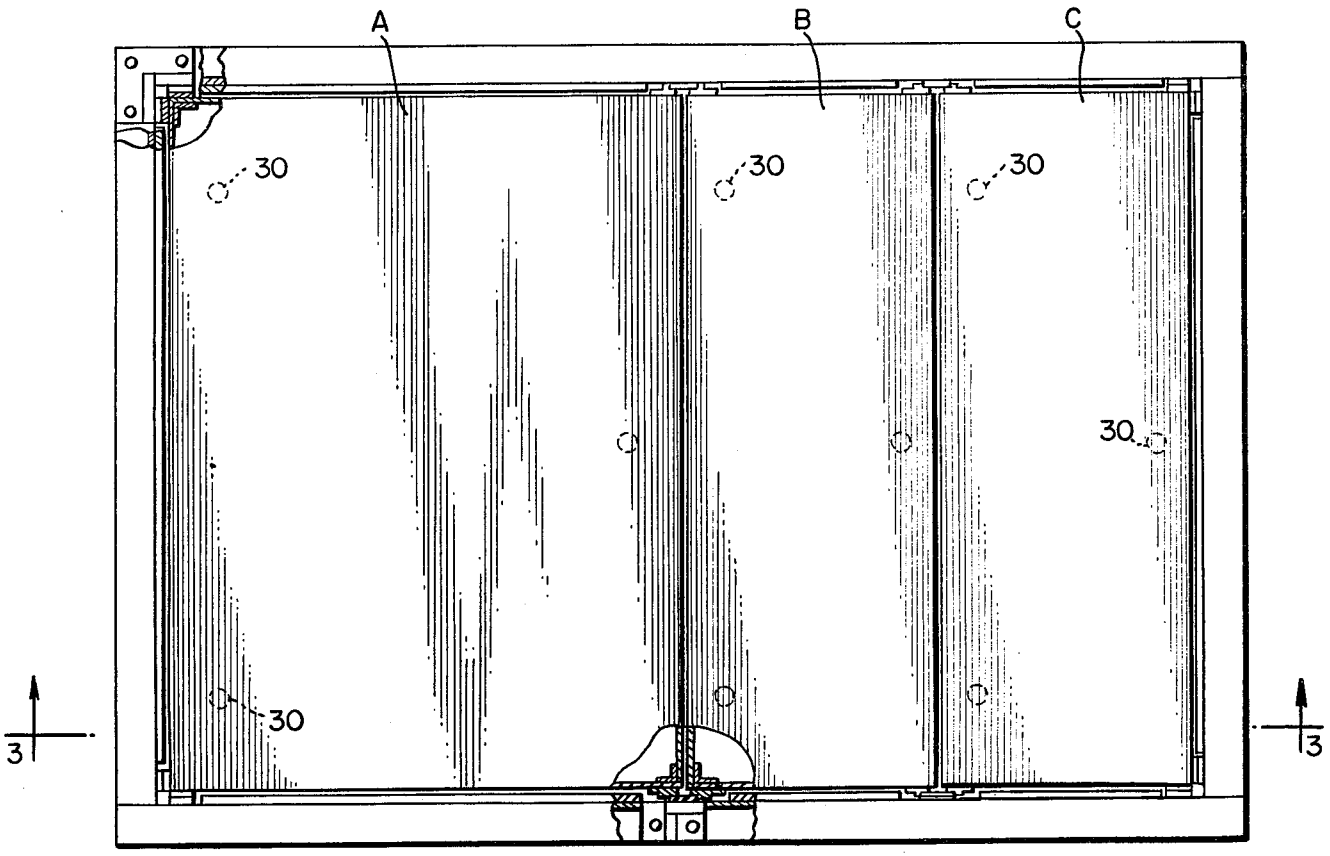
FIG. 2 is a plan view of the multiple section skid lift assembly of the present invention.
Figure 3:
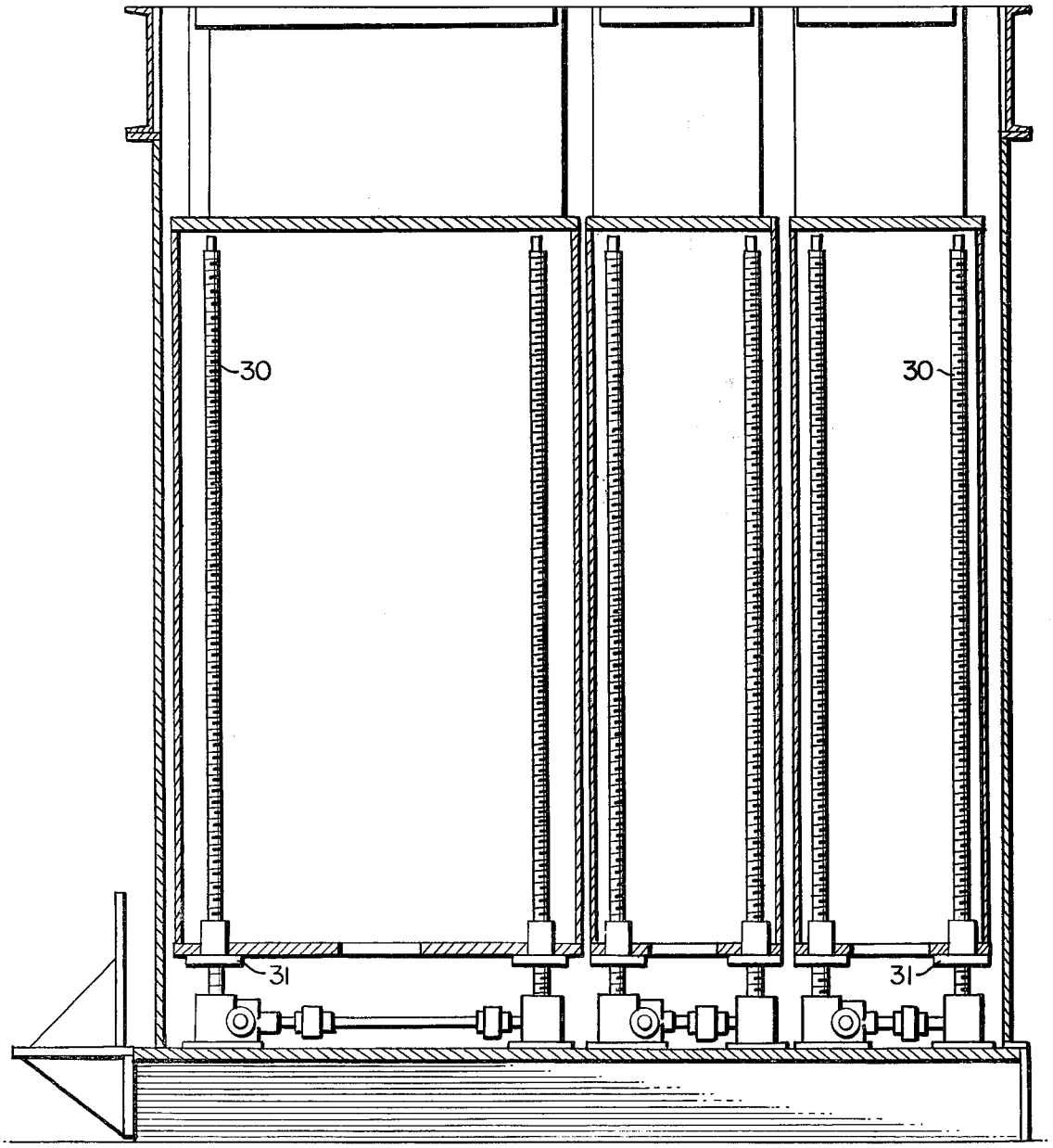
FIG. 3 is a side sectional view of FIG. 2 taken along the lines 3—3 of FIG. 2.
Figure 4:
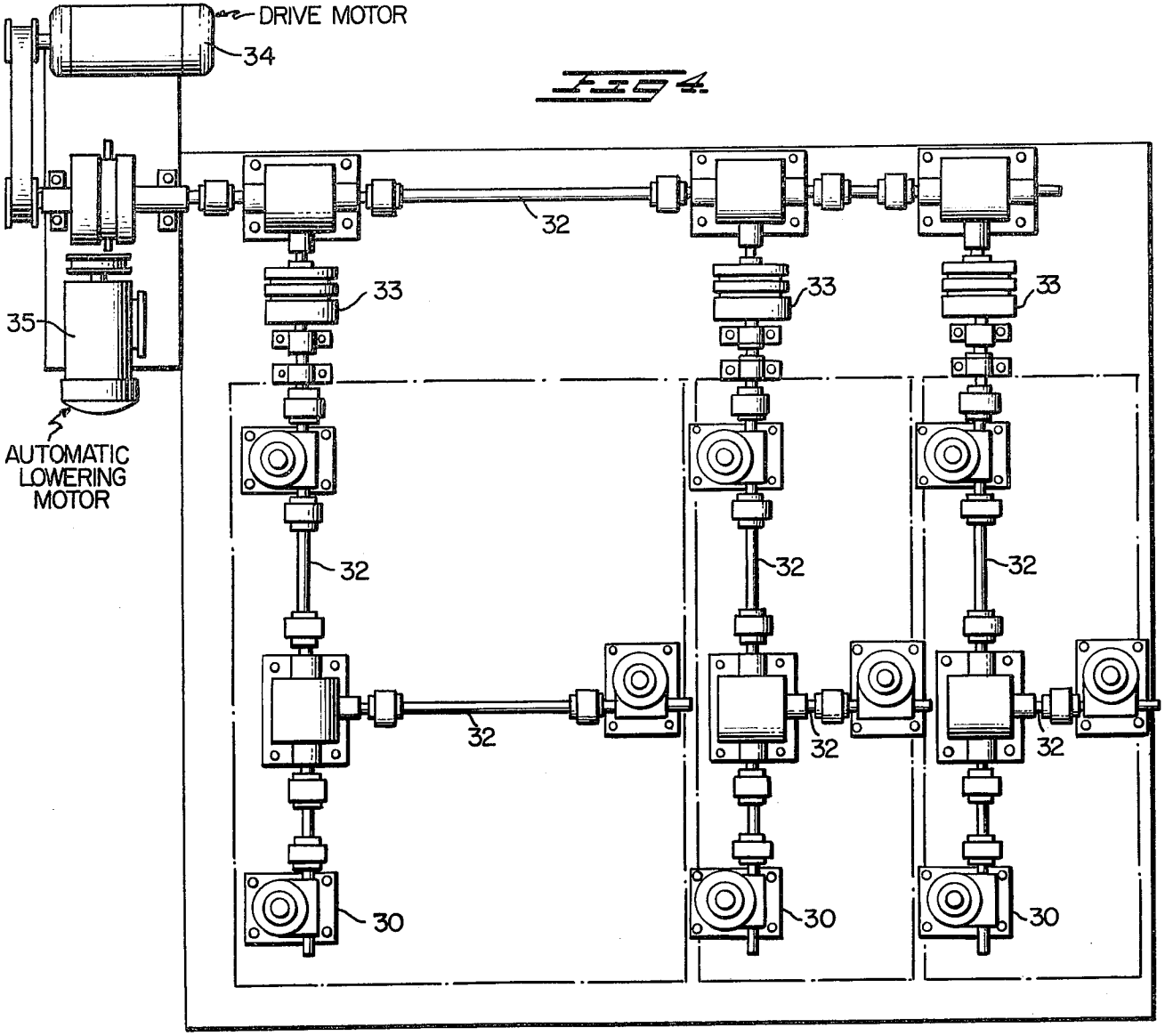
FIG. 4 is a plan view of the drive components for the skid lift assembly shown in FIG. 2; and, FIG. 5 shows schematically the jogger rail lift controls for the sheet stacking mechanism of the present invention.

FIGS. 2–4 show schematically a preferred method for adjusting the height of the skid lift platform sections A, B and C. Each section is supported by three screws 30 which pass through ball screw nuts 31 mounted on the base of the respective sections. The screws 30 are in turn actuated by a drive system utilizing drive shafts 32 and clutch brakes 33, substantially as shown in plan in FIG. 4, for actuating one or more of the skid lift sections as desired. A primary drive motor 34 is provided for driving screws 30 to produce gross changes in the height of the respective sections and a second more sensitive drive motor 24 is provided for the automatic and continuous skid lift lowering feature of the invention. It should be understood, however, that the present invention is not limited to the scheme shown in FIG. 4 since other and different mechanical components could be provided for accomplishing the desired purpose.

As shown in FIG. 1B, the skid lift sections A, B and C are normally lowered to the nominal floor level when the machine is not in operation. When stacking is to be done, a stacking skid is placed on the skid lift platforms which are raised to the desired stacking level with drive motor 34, using the number of skid lift sections required. When the stacking skid is at the proper level, the jogger rails and joggers are lowered down until the joggers are resting on the extended edges of the stacking skid. The force exerted by the joggers on the stacking skid is controlled by adjusting the air pressure in the float cylinder 45. When stacking is started, the joggers follow the skid downwardly for a limited distance to insure proper stacking as the stack begins. The stack is lowered automatically and continuously at a rate that is determined by the basis weight of the sheeted paper and the machine speed. These parameters are entered into the control circuit (not shown) by the machine operator. When automatic skid lowering is used, drive motor 35 is engaged which continuously and automatically lowers the skid lift sections as the stack of paper increases in height. After the stack is completed, the jogger rails and tamper are both raised out of the way, the skid lift sections are adjusted to bring the skid back up to floor height, and the finished skid is removed. At this point, the machine is ready to start another stacking operation.

Figure 5:
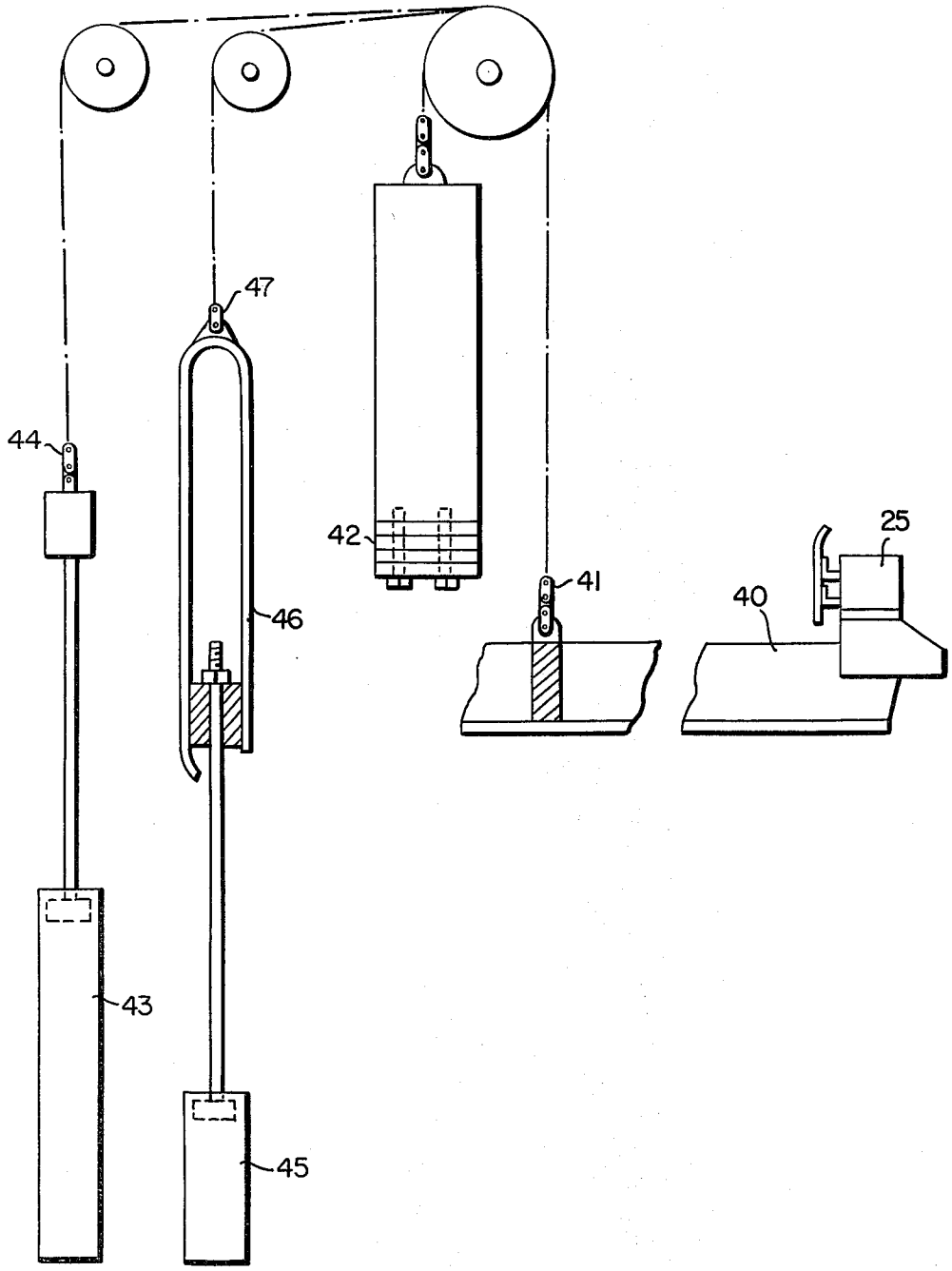

The controls for the jogger rails are preferably pneumatic but could readily be operated electrically or hydraulically depending on the system desired. FIG. 5 illustrates schematically a typical pneumatic system useful for balancing the jogger rails and joggers in position adjacent the paper stack. Basically, the jogger rails 40 are mounted in pairs at each side of the machine on the machine frame 23. Each jogger rail carries one or more sheet jogging devices of the type more fully disclosed in U.S. Pat. No. 3,982,751 for aligning the sheets as they are fed to the stack. Means (not shown) is provided for moving the jogger rails 40 fore and aft in the direction of sheet delivery for orienting the jogging devices properly for the sheet size being stacked and the pneumatic system of FIG. 4 is utilized for raising and lowering the jogger rails when a skid is started and a finished skid is removed. Essentially, the jogger rail suspension system consists of a statically counterweighted system with pneumatically actuated devices for raising and lowering the jogger rails and for producing a floating condition. The jogger rails 40 are each attached via roller chains 41 to a counter weight system 42. Meanwhile, an air lift cylinder 43 is located in one of the machine frame pedestals 23 which is also connected to the jogger rails 40 via a roller chain 44 and a float cylinder 45 is located in another of the machine frame pedestals 23 through a yoke device 46 and connected to the jogger rails 40 via roller chain 47. For gross up and down movements of the jogger rails 40, the air cylinder 43 is utilized. However, under operating conditions, the position of the jogger rails is determined by the float cylinder 45 and yoke mechanism 46. The machine operator's control panel (not shown) includes inputs for controlling the movement of the jogger rails and the actuation of the joggers.

The sheet tamper mechanism is also pneumatically actuated for a tamping motion or a fully up or fully down condition. The details of operation of the tamper are not critical to the operation of the stacking mechanism disclosed herein, hence it is not disclosed in any detail. In fact, when the machine shown in FIGS. 1A and 1B is used to sheet two webs in side-by-side relation, the tamper paddle is generally removed and replaced with a stack divider.

Accordingly, it may be seen that the present invention provides a useful and versatile sheet stacking mechanism for accomodating a wide range of sheet sizes. It will further be understood that while only a preferred embodiment of the invention has been illustrated and described in detail, many variations and modifications could be made by one skilled in the art within the scope of the invention as defined in the appended claims.

I claim:

1. A sheet receiving and stacking means for a fixed height sheet delivery device comprising a stack supporting skid lift assembly consisting of a plurality of skid lift sections arranged adjacent to one another at the delivery end of said sheet delivery device, a jogger rail assembly including joggers located adjacent to said skid lift assembly for successively aligning the edges of sheets being stacked, means for adjusting said jogger rail assembly for stacking a wide range of sheet sizes and a means for automatically lowering the skid lift assembly to accomodate the increasing height of the stack as sheets are deposited thereon, the improvement comprising means for stacking a wide range of sheet sizes wherein each skid lift section includes means for independently adjusting its vertical height, said means comprising a plurality of driven means comprising screws which drivingly engage ball nuts mounted on the base of each skid lift section to provide the source of vertical movement, a separate clutch assembly connected to the plural driven means for each skid lift section, a primary drive means connected to said clutch assemblies for providing gross changes in the vertical height of the skid lift sections and a secondary drive means connected to said clutch assemblies for automatically lowering the skid lift sections to accomodate the increasing height of the stack as sheets are deposited thereon.

2. A sheet cutting, conveying and stacking machine comprising in combination, means for advancing a web of material to a sheet cutting device where the web is cut into sheets, a sheet receiving and conveying means for conveying the cut sheets from the cutting device to a sheet collecting station and a sheet slow down and delivery means for delivering the cut sheets to a skid located on a stacking station at the delivery end of said machine, the improvement comprising means for stacking a wide range of sheet sizes said means comprising:

(a) a skid lift assembly consisting of a plurality of skid lift sections mounted for independent vertical movement within and above an underfloor area at the delivery end of said machine;

(b) an adjustable jogger rail assembly including joggers located adjacent to said skid lift assembly for successively aligning the edges of sheets stacked on a skid located on one or more of said skid lift sections;

(c) a plurality of driven means comprising screws for each skid lift section which drivingly engage ball nuts mounted on the base of each skid lift section to provide the source of vertical movement;

(d) a separate clutch assembly connected to the plural driven means of each skid lift section;

(e) a primary drive means connected to said clutch assemblies for providing gross changes in the vertical height of the skid lift sections; and, (f) a secondary drive means connected to said clutch assemblies for automatically and continuously changing the vertical height of said skid lift sections and skid as sheets are deposited thereon for accomodating the increasing height of the stack.

* * * * *